US010748512B1

(12) United States Patent
Watkins

(10) Patent No.: US 10,748,512 B1
(45) Date of Patent: Aug. 18, 2020

(54) ACOUSTIC GUITAR FRAME

(71) Applicant: David B. Watkins, Jackson, MO (US)

(72) Inventor: David B. Watkins, Jackson, MO (US)

( * ) Notice: Subject to any disclaimer, the term of this patent is extended or adjusted under 35 U.S.C. 154(b) by 0 days.

(21) Appl. No.: 16/677,611

(22) Filed: Nov. 7, 2019

Related U.S. Application Data

(60) Provisional application No. 62/803,624, filed on Feb. 11, 2019.

(51) Int. Cl.
*G10D 1/08* (2006.01)
*G10D 3/04* (2020.01)
*G10D 3/06* (2020.01)

(52) U.S. Cl.
CPC ..... *G10D 1/08* (2013.01); *G10D 3/04* (2013.01); *G10D 3/06* (2013.01)

(58) Field of Classification Search
CPC ..... G10D 1/08
See application file for complete search history.

(56) References Cited

U.S. PATENT DOCUMENTS 1,596,763 A * 8/1926 Place, Jr. ..... G10D 1/10 84/293
3,443,465 A * 5/1969 Kasha ..... G10D 1/08 84/267
4,073,211 A * 2/1978 Jorgensen ..... G10D 1/08 84/267
4,121,492 A * 10/1978 Berardi ..... G10D 3/06 84/293
4,304,277 A * 12/1981 Petillo ..... G10D 3/06 144/350
4,836,076 A * 6/1989 Bernier ..... G10D 3/22 84/275
4,846,038 A * 7/1989 Turner ..... G10D 3/06 84/293
5,233,896 A * 8/1993 Worthington ..... G10D 3/06 84/293
5,864,073 A * 1/1999 Carlson ..... G10D 3/06 84/267
6,111,175 A * 8/2000 Lasner ..... G10D 3/06 84/290
6,255,567 B1 * 7/2001 Minakuchi ..... G10D 1/085 84/291
D516,114 S * 2/2006 Leach ..... G10D 1/08 D17/20
7,164,072 B2 * 1/2007 Park ..... G10D 3/02 84/294
7,446,247 B2 * 11/2008 Shellhammer ..... G10D 3/02 84/267

(Continued)

*Primary Examiner* — Robert W Horn
(74) *Attorney, Agent, or Firm* — Christopher Mayle; John D. Houvener; Bold IP, PLLC

(57) ABSTRACT

A system and method directed for an aluminum guitar frame or chassis contained or suspended inside a wooden acoustic guitar. The frame having a neck that provides a rigid skeletal frame for the guitar's neck that eliminates truss rods and need for adjustments, a suspended body frame that transfer energy from the strings to the sound board more efficiently while providing longer sustainability, and an adjustable bridge suspension system allowing for slight adjustments to the action of the strings while enhancing resonance of the sound board as well as reducing the amount of bracing required permitting the sound board to be thinner while enhancing the tone.

20 Claims, 7 Drawing Sheets

(56) References Cited

U.S. PATENT DOCUMENTS

| | | | | |
|---|---|---|---|---|
| 7,462,767 | B1 * | 12/2008 | Swift | G10D 3/00 84/173 |
| 7,652,205 | B2 * | 1/2010 | Leach | G10D 1/08 84/267 |
| 7,902,442 | B2 * | 3/2011 | Leach | G10D 1/08 84/293 |
| 8,008,558 | B2 * | 8/2011 | Koentopp | G10D 3/02 84/267 |
| 8,138,403 | B1 * | 3/2012 | Kemp | G10D 3/02 84/267 |
| 8,183,446 | B1 * | 5/2012 | Ward | G10D 1/08 84/267 |
| 8,203,058 | B2 * | 6/2012 | Leach | G10D 1/08 84/267 |
| 8,648,238 | B1 * | 2/2014 | Trabits | G10D 3/04 84/298 |
| 9,000,282 | B1 * | 4/2015 | Booth | G10D 3/02 84/291 |
| 9,123,312 | B2 * | 9/2015 | McCabe | G10D 3/153 |
| 9,514,719 | B1 * | 12/2016 | Ward | G10D 1/08 |
| 9,576,560 | B2 * | 2/2017 | Furch | G10D 1/08 |
| 10,373,593 | B1 * | 8/2019 | Campfield | G10D 3/06 |
| 2007/0289427 | A1 * | 12/2007 | Liang | G10D 1/08 84/291 |
| 2008/0190263 | A1 * | 8/2008 | Drew | G10D 3/02 84/291 |
| 2011/0179937 | A1 * | 7/2011 | Miloslaysky | G10D 3/12 84/291 |
| 2016/0332285 | A1 * | 11/2016 | Chen | B25B 15/008 |
| 2018/0211639 | A1 * | 7/2018 | Niiro | G10D 1/085 |

* cited by examiner

ACOUSTIC GUITAR FRAME

This application is a non-provisional application which claims priority to U.S. Provisional Application No. 62/803,624 filed on Feb. 11, 2019, which is incorporated by reference in its entirety.

FIELD OF DISCLOSURE

The field of disclosure is generally directed to the field of acoustic guitars and more particularly a frame utilized under a guitar sound board to provide a structural skeleton to eliminate bowing and warping in the neck of the guitar.

BACKGROUND

The sound board of an acoustic guitar plays an important role in the sound being produced by the guitar by turning the vibration from the forces exerted by the strings into waves of pressure. The sound board is braced to help distribute the force exerted by the neck of the guitar on the body, and to maintain the tonal responsiveness and structural integrity of the guitar. Bracing also helps controls the manner in which the sound board vibrates as well as stiffens the sound board to minimize distortion of the sound board from the tension applied by the strings. The neck, back, length, box size, and string type also affect the volume and tone, but the actual bracing usually has the greatest impact to the overall sound.

Conventionally there have been many types of bracing systems used with classical acoustic guitars. For instance, ladder bracing involves bracing struts extending from edge to edge of the body perpendicular to the grain of the sound board. Fan bracing is when the struts extend radially outwardly generally below a sound hole, but starting above the bridge location. A problem with these conventional methods is that they become loose either from the adhesive weakening or the guitar getting knocked around from everyday use. Also, as the bracing ages it may lose some of its structural integrity whereby the guitar may become warped and unplayable.

To also counteract the tension created by the strings, a truss rod may be used. A guitar neck is typically made of wood, thus many guitars need a slight truss rod adjustment from either normal wear of the guitar neck from humidity or when switching to a thicker gauged string set. A truss rod is designed to keep the neck straight by countering the pull of the strings and natural tendencies in the wood. A truss rod is typically an interior metal bar that runs the entire length of a guitar's neck.

Loosening a truss rod lowers the amount of resistance counteracting the tension created by the strings causing relief in a guitar neck, also known as forward-bow where there is a slight curvature in the guitar neck bringing the center of the fretboard away from the strings. Intense relief in the guitar neck may cause high action, uncomfortable playing, and may affect the intonation of the guitar. Tightening the truss rod forces the neck to flatten out and bring the center of the fretboard back closer to the strings.

Tightening a truss rod causes the neck to form into a convex shape known as "back-bow" bringing the center of the fretboard closer to the strings. Back-bow may cause the guitar to be played improperly and can cause string buzzing when strung or lead to dead strings. Loosening the truss rod allows the neck to return in alignment and assume a more natural shape under the tension from the strings. Constantly adjusting the truss rod can be quite taxing. When repairing a truss rod, removing the truss rods requires removal of the fingerboard, which in turn requires a complete refret and finish work, proving to be quite expensive.

There have been other attempts to create an acoustic guitar with enhanced structural capability. For example, acoustic guitar models have been made with solid aluminum necks. However these types of guitars failed because the frets were formed into the neck as one solid piece of aluminum. This caused the frets to wear out too quickly because the aluminum was too soft.

There are also guitar designs that incorporate metal rods into the infrastructure to reinforce the bridge underneath the sound board. However the rods are not adjustable and do not incorporate the neck of the guitar, thus not preventing the neck from bowing and warping. Though the guitar industry does have many purists who are looking for a conventional experience, there are many new materials and technologies that may be used to solve these problems. Thus exists a need for a guitar frame that not only provides bracing but also eliminates the need for a truss rod to prevent warping and neck bowing.

SUMMARY

The disclosure presented herein relates to a guitar frame system comprising, an adjustable hinge, the adjustable hinge adjustably engageable with an engaging fastener, for enabling adjustment of the adjustable hinge relative to a bridge plate secured to an interior of a sound board of a guitar, the guitar frame system made of aluminum or an aluminum alloy, a body frame having a rectangular cross section with a first longitudinal member and second longitudinal member, the first longitudinal member and the second longitudinal member including a hole extending through a lateral surface of the first and the second longitudinal members, the first and the second longitudinal member connected by a barrel member, the barrel member connected to the adjustable hinge whereby the adjustable hinge is pivotally connected to the first longitudinal member and second longitudinal member, a first rod having a first arcuate end portion, a straight middle section, and a second arcuate end portion and a second rod having a first end arcuate portion, a straight middle section, and a second arcuate end portion, the bridge plate connected to the first arcuate end portion of the first rod and the second rod, the second arcuate end portions of the first rod and the second rod connected to the adjustable hinge.

The disclosure presented herein also relates to a guitar frame system comprising: a body frame with a first longitudinal member and second longitudinal member, the first longitudinal member and the second longitudinal member including a hole extending through a lateral surface of the first and the second longitudinal members, the first and the second longitudinal member connected by a barrel member, the barrel member connected to the adjustable hinge whereby the adjustable hinge is pivotally connected to the first longitudinal member the and second longitudinal member, the adjustable hinge adjustably engageable with an engaging fastener, for enabling adjustment of the adjustable hinge relative to a bridge plate secured to an interior of a sound board of a guitar, a first rod and a second rod having the bridge plate connected to a first end portion of the first rod and the second rod, a second end of the first rod and the second rod connected to the adjustable hinge, whereby the engaging fastener is a socket head cap screw having a circular face flange and a hex depression configured for engaging with a hex keyed wrench, the screw threaded through a threaded hole of the adjustable hinge, the screw placed through an opening in a base of the guitar, the flange attached to the body frame, a neck frame, the neck frame comprised of two members arranged in a T shaped configuration that runs down the center of the entire length of the neck frame.

BRIEF DESCRIPTION OF DRAWINGS

The present invention will be described by way of exemplary embodiments, but not limitations, illustrated in the accompanying drawings in which like references denote similar elements, and in which.

DETAILED DESCRIPTION

Figure 1:
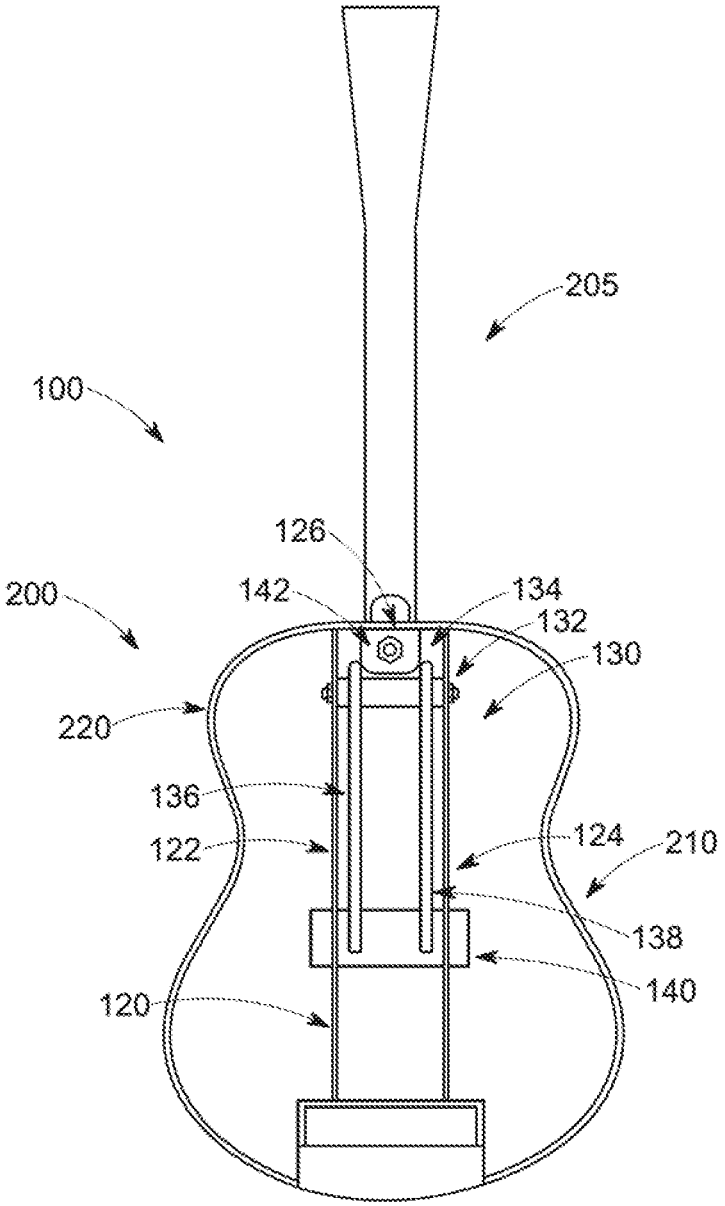
FIG. 1 illustrates a front view of the system of the present invention, including the guitar frame and guitar.
Figure 2:
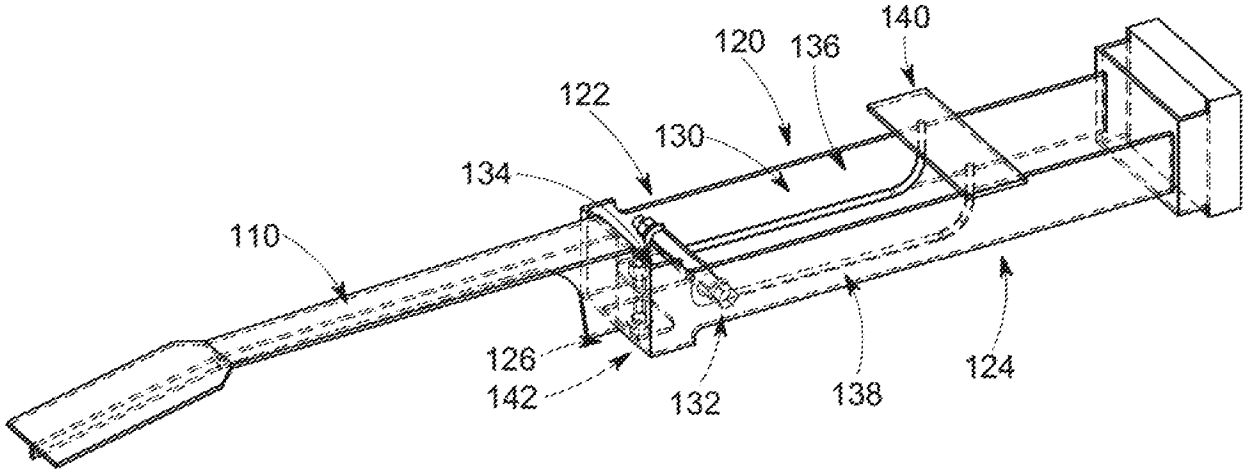
FIG. 2 illustrates a perspective view of the system of the present invention, including the guitar frame
Figure 3:
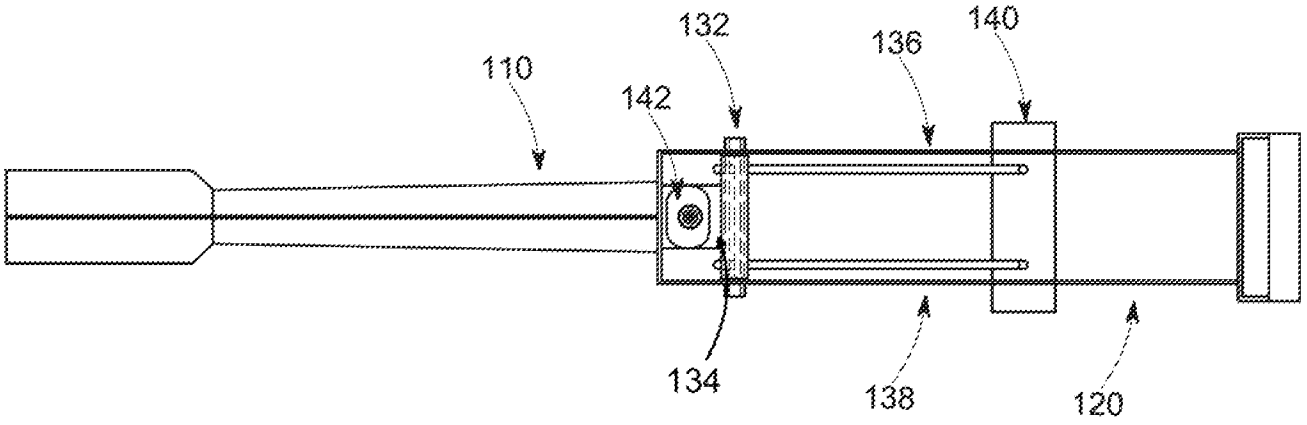
FIG. 3 illustrates a top view of the system of the guitar frame.
Figure 4:
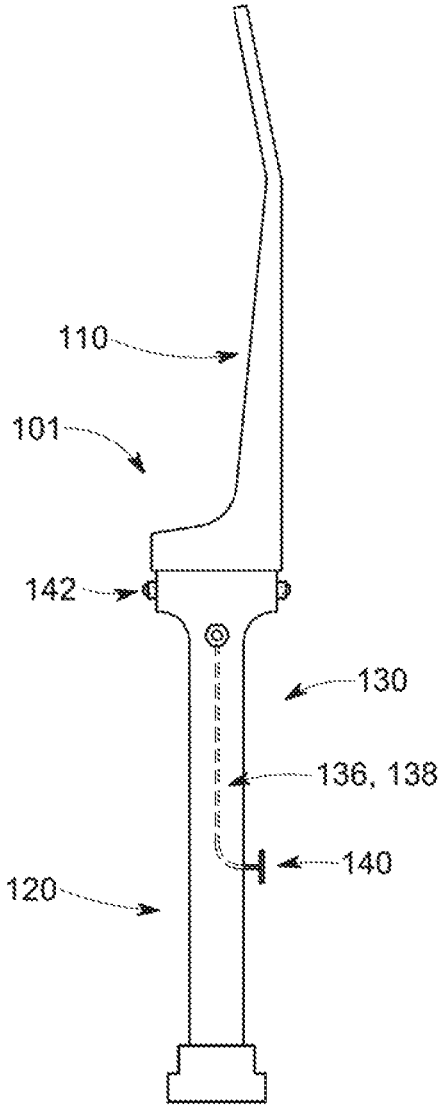
FIG. 4 illustrates a side view of the system of the guitar frame.
Figure 5:
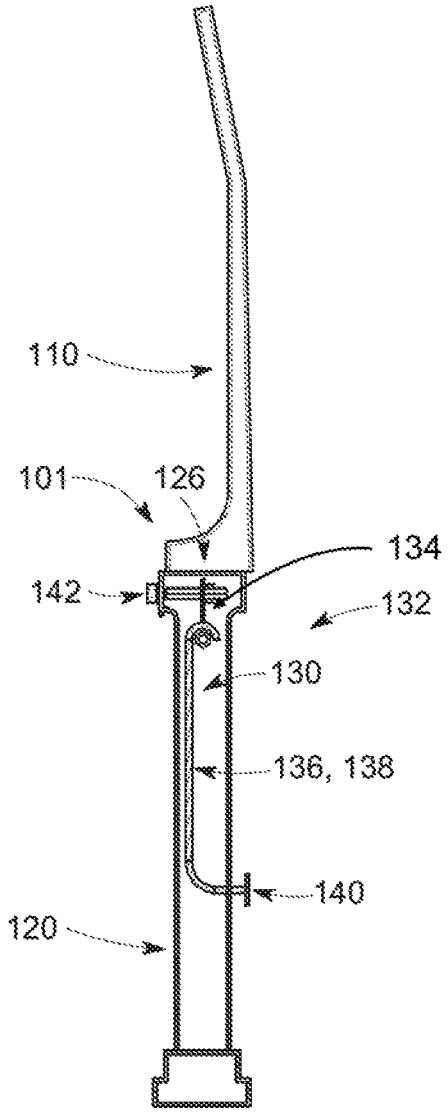
FIG. 5 illustrates another side view of the system of the guitar frame.

In the Summary above and in this Detailed Description, and the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, etc. are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range including that number (which may be a range having an upper limit or no upper limit, depending on the variable being defined). For example, "at least 1" means 1 or more than 1. The term "at most" followed by a number is used herein to denote the end of a range, including that number (which may be a range having 1 or 0 as its lower limit, or a range having no lower limit, depending upon the variable being defined).

"Exemplary" is used herein to mean "serving as an example, instance, or illustration." Any aspect described in this document as "exemplary" is not necessarily to be construed as preferred or advantageous over other aspects Throughout the drawings, like reference characters are used to designate like elements. As used herein, the term "coupled" or "coupling" may indicate a connection. The connection may be a direct or an indirect connection between one or more items. Further, the term "set" as used herein may denote one or more of any item, so a "set of items," may indicate the presence of only one item, or may indicate more items. Thus, the term "set" may be equivalent to "one or more" as used herein.

In the following detailed description, numerous specific details are set forth in order to provide a more thorough understanding of the one or more embodiments described herein. However, it will be apparent to one of ordinary skill in the art that the invention may be practiced without these specific details. In other instances, well-known features have not been described in detail to avoid unnecessarily complicating the description.

The present disclosure is generally drawn to a system and method, according to one or more exemplary embodiments, for an acoustic guitar frame. The acoustic guitar frame eliminates warping and bowing of a guitar's neck while also enhancing the tone sustainability and harmonics of the guitar while being played. The acoustic guitar frame is made of three main components: a neck frame, a suspended body frame, and an adjustable bridge suspension system. The neck frame provides a rigid skeletal frame for a guitar's neck configured so that the guitar neck will not warp. The neck frame also eliminates the need for a truss rod and any adjustments that need to be made to the truss rod. The suspended body frame is designed to transfer energy from the strings to sound board more efficiently than wood to provide longer sustainability for the guitar. The adjustable bridge suspension allows for slight adjustments to the action of the strings and enhances resonance of the sound board as well as allows the user to reduce the amount of bracing required for the sound board whereby the sound board may be made thinner, thus enhancing the tone.

With reference now to FIG. 1, one exemplary embodiment of guitar frame system 100 having a body frame such as body frame 110, a neck frame such as neck frame 120, and adjustable bridge suspension system such as adjustable bridge suspension system 130. Guitar frame may be made of an aluminum or an aluminum alloy such as 6061 aluminum alloy, containing magnesium and silicon as its major alloying elements but may be any type of metal, alloy, or composite that prevents warping or bending without any reinforcement. Aluminum may be coated with a material such as plastic to prevent the oxide that forms to provide a smooth surface.

Guitar frame 101 may be positioned inside of a wooden acoustic guitar such as guitar 200. Guitar may have a neck such as neck 205, a base such as base 210, and a sound board or top such as sound board 220. Sound board 220, may have a top surface and a bottom surface with a top end proximate to neck 205, and a bottom surface proximate to the bottom side of guitar 200. Base 210 may have a top surface and a bottom surface with a top end proximate to the neck 205, and a bottom end proximate to the heel of guitar 200. Guitar 200 may include any number of ornamental features or materials such as but not limited to engravings, fabric, or paint coloring. Guitar 200 may be of any shape, designs, and configurations that does not stray from the spirit and scope of the present invention and in one or more non-limiting embodiments may be adapted to contain all, some, or none of the guitar frame 101, whereby guitar frame 101 may or may not be visible.

In some embodiments, one or more pairs of x crossed braces may be affixed to the bottom surface of sound board 220 or brace 210 to provide added support for guitar 200 in resisting warping and distortion due to the string tension. In one or more non-limiting embodiments, other bracing known by those of ordinary skilled in the art may be utilized. Sound board 220 may have strings strung to a headstock on neck 205. Strings may be nylon, steel, or any other material known by those of ordinary skill in the art.

Neck frame 110 may be comprised of two members that are ⅛" thick arranged in a "T" shaped configuration that runs down the center of the entire length of neck 205. Neck frame 110 may be completely interior to neck 205, while in one or more non-limiting embodiments may replace neck 205, while in further embodiments neck frame 110 may protrude outward from neck 205 whereby a section of the neck frame is in contact with the exterior of soundboard 220. Neck frame 110 may be coupled or attached to body frame 120. For example, neck frame 110 may be welded, soldered, glued, or otherwise coupled to body frame 120. In one or more non-limiting embodiments, neck frame 110 may be integral with body frame 120.

Body frame 120 only makes contact with the top side and bottom side of guitar 200 while in other non-limiting embodiments only makes contact with attachment points, such as the top block and bottom block of guitar. Body frame 120 may have a rectangular cross section or substantially rectangular cross section with a first longitudinal member such as first longitudinal member 122 and second longitudinal member such as second longitudinal member 124. In one or more non-limiting embodiments, the first and second longitudinal members 122 and 124 may be extendable or otherwise provide telescopic movement to permit modification of the overall length to adapted to differently sized guitars.

First longitudinal member 122 and second longitudinal member 124 may include a hole extending through the lateral surface of first and second longitudinal members 122 124 whereby the holes may be axially aligned with each other and adjustable bridge suspension system 130 by a barrel member such as barrel member 132 attached or integral to an adjustable hinge such as adjustable hinge 134 whereby one or more fasteners such as a pivot screw, pulling pin, or other fastener may be placed through the holes of first longitudinal member 122 and second longitudinal member 124 and barrel member 132 so that adjustable hinge 134 is pivotally connected to the first longitudinal member 122 and second longitudinal member 124 and thus body frame 120.

Adjustable bridge suspension system 130 may include a ¼ inch diameter first rod such as first rod 136 that has a first arcuate end portion, a generally straight middle section, and a second arcuate end portion and a ¼ inch diameter second rod such as second rod 138 that has a first end arcuate portion, a generally straight middle section, and a second arcuate end portion. A bridge plate such as bridge plate 140 is preferably mounted to the first arcuate end portion of first rod 136 and second rod 138. Bridge plate 140 is fastened to the interior of sound board 220 by adhesive or any other fastening method known by those of ordinary skill in the art. A material such as post-formed plastic laminate may be used as a buffer that is attached between sound board 220 and bridge plate 140, so that bridge plate 140 does not come in direct contact with the interior of sound board 220.

The second arcuate end portions of the first and second rods 136 and 138 are connected to adjustable hinge 134. The second arcuate end portions of the first and second rod also form a convex center segment extend inwardly toward barrel member 132. Adjustable hinge may have one or more receiving holes bored through to receive a screw or other fastener as dictated by the material, such as screw 142. The receiving holes may be threaded suitably adapted to receive a correspondingly threaded screw or fastener such as screw 142 whereby screw 142 is adapted to fit through the threaded holes.

In the preferred embodiment, screw 142 is a socket head cap screw having a circular face flange and a hex depression configured for engaging with a hex keyed wrench, to turn screw 142. However this is non limiting and the screw may be any type of screw. Screw is placed through the opening in the base 210 of guitar 200 near neck 205, and placed through a flange such as flange 126 attached, fastened, or integral to body frame 120, flange 126 having a receiving hole configured to allow screw 142 to pass through. The hole in flange 126 and adjustable hinge 134 are located on the same axial plane whereby the holes are coaxially aligned. Screw 142 then is threaded through the threaded hole of the adjustable hinge 134 and anchored with one or more snap rings anchoring screw 142, securing adjustable hinge 134 to screw 142, whereby screw 142 is either protruding or accessible from base 210 of guitar 200 to be adjusted.

Figure 6:
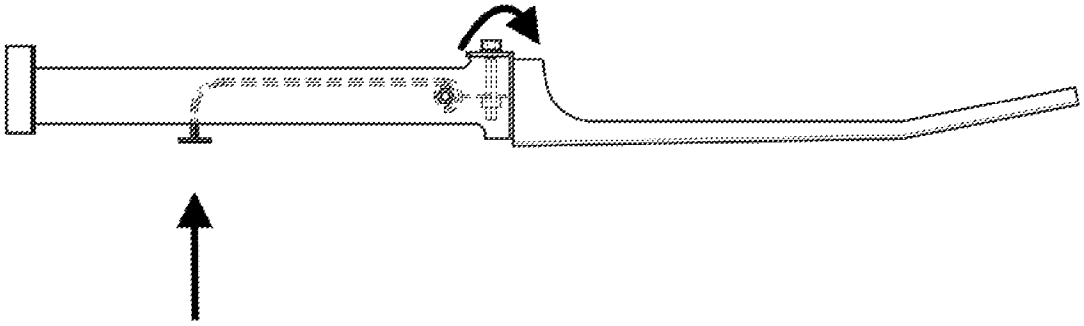
FIG. 6 illustrates tightening of the screw for lateral adjustment on bridge plate.
Figure 7:
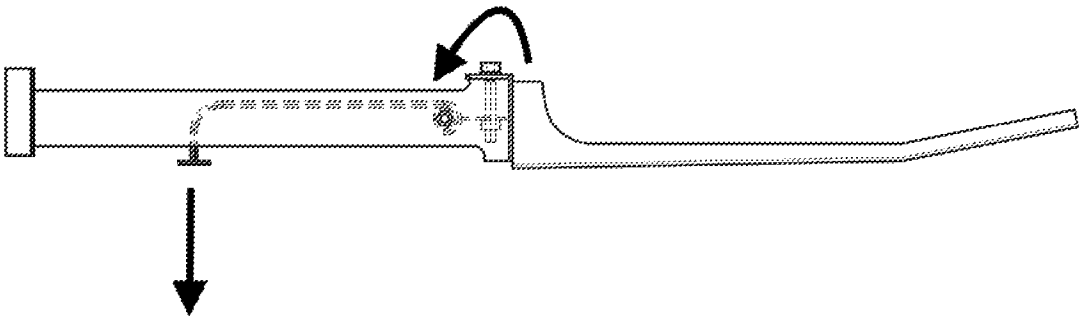
FIG. 7 illustrates loosening of the screw for lateral adjustment on bridge plate.

This permits a lateral adjustment on adjustable hinge 134 by the adjustment of screw 142 by a user. If adjustment of the adjustable hinge 134 relative to bridge plate 140 is desired, it may be accomplished by tightening or loosening screw 142 thereby adjusting the threading inwardly or outwardly as illustrated in FIGS. 6 and 7. By tightening screw 142, adjustable hinge 134 may be pressed away from bridge plate 140. Thus, a bending tension is produced between adjustable hinge 134 and bridge plate 140 that provides a downward pressure on bridge plate 140. By loosening screw 142, adjustable hinge 134 may be pressed toward bridge plate 140. Thus, a bending tension is produced between adjustable hinge 134 and bridge plate 140 that provides an upward pressure on bridge plate 140. The tightening and loosening of screw 142 changes the action, playability, and tone of the guitar. Tightening and loosening of screw 142 may be done in a clockwise or counterclockwise and is not limited to the illustrated embodiments. In other embodiments when loosening screw 142, adjustable hinge 134 may be pressed away from bridge plate 140 and when tightening screw, adjustable hinge 134 may be pressed towards bridge plate 140.

With the present invention there will no longer be any warping of the neck, the energy transferred from the strings to the sound board will be more efficient, and slight adjustments may be made to enhance the resonance of the sound board The foregoing description of the invention has been presented for purposes of illustration and description and is not intended to be exhaustive or to limit the invention to the precise form disclosed. Many modifications and variations are possible in light of the above teaching. The embodiments were chosen and described to best explain the principles of the invention and its practical application to thereby enable others skilled in the art to best use the invention in various embodiments and with various modifications suited to the use contemplated.

What is claimed is:

1. A guitar frame system comprising, an adjustable hinge, the adjustable hinge adjustably engageable with an engaging fastener, for enabling adjustment of the adjustable hinge relative to a bridge plate secured to an interior of a sound board of a guitar; and a body frame having a rectangular cross section with a first longitudinal member and second longitudinal member.

2. The guitar frame system of claim 1, the guitar frame system made of aluminum or an aluminum alloy.

3. The guitar frame system of claim 1, the first longitudinal member and the second longitudinal member including a hole extending through a lateral surface of the first and the second longitudinal members, the first and the second longitudinal members connected by a barrel member, the barrel member connected to the adjustable hinge wherein the adjustable hinge is pivotally connected to the first longitudinal member and second longitudinal member.

4. The guitar frame system of claim 3 further comprising: a first rod having a first arcuate end portion, a straight middle section, and a second arcuate end portion and a second rod having a first end arcuate portion, a straight middle section, and a second arcuate end portion, the bridge plate connected to the first arcuate end portion of the first rod and the second rod, the second arcuate end portions of the first rod and the second rod connected to the adjustable hinge.

5. The guitar frame system of claim 1 wherein the bridge plate is secured to the interior of the sound board, wherein a buffer is attached between the interior of the sound board and the bridge plate.

6. The guitar frame system of claim 1, wherein the engaging fastener is a socket head cap screw having a circular face flange and a hex depression configured for engaging with a hex keyed wrench, the screw threaded through a threaded hole of the adjustable hinge.

7. The guitar frame system of claim 1, comprising a neck frame.

8. The guitar frame system of claim 7, the neck frame comprised of two members arranged in a T shaped configuration that runs down the center of the entire length of the neck frame.

9. The guitar frame system of claim 8, the neck frame completely interior to a neck of the guitar.

10. The guitar frame system of claim 8, wherein the neck frame is a neck of the guitar.

11. A guitar frame system comprising: a body frame with a first longitudinal member and second longitudinal member, the first longitudinal member and the second longitudinal member including a hole extending through a lateral surface of the first and the second longitudinal members, the first and the second longitudinal member connected by a barrel member, the barrel member connected to the adjustable hinge wherein the adjustable hinge is pivotally connected to the first longitudinal member and the second longitudinal member, the adjustable hinge adjustably engageable with an engaging fastener, for enabling adjustment of the adjustable hinge relative to a bridge plate secured to an interior of a sound board of a guitar.

12. The guitar frame system of claim 11 further comprising: a first rod and a second rod having the bridge plate connected to a first end portion of the first rod and the second rod, a second end of the first rod and the second rod connected to the adjustable hinge.

13. The guitar frame system of claim 12, wherein the engaging fastener is a socket head cap screw having a circular face flange and a hex depression configured for engaging with a hex keyed wrench, the screw threaded through a threaded hole of the adjustable hinge.

14. The guitar frame system of claim 13, the screw placed through an opening in a base of the guitar, the flange attached to the body frame.

15. The guitar frame system of claim 14, comprising a neck frame.

16. The guitar frame system of claim 15, the neck frame comprised of two members arranged in a T shaped configuration that runs down the center of the entire length of the neck frame.

17. The guitar frame system of claim 11, further comprising: a buffer attached between the sound board and the bridge plate.

18. The guitar frame system of claim 11, the guitar frame system made of aluminum or an aluminum alloy.

19. A guitar frame system comprising, an adjustable hinge, the adjustable hinge adjustably engageable with an engaging fastener, for enabling adjustment of the adjustable hinge relative to a bridge plate secured to an interior of a sound board of a guitar, wherein when the engaging fastener is adjusted the adjustable hinge provides an upward or downward pressure on the sound board.

20. The guitar frame system of claim 19 wherein the guitar frame system is positioned inside a body of the guitar.

* * * * *